United States Patent [19]

Van Wagener et al.

[11] Patent Number: 4,775,337

[45] Date of Patent: Oct. 4, 1988

[54] CONDUCTIVE WIRE WITH INTEGRAL ELECTRICAL TERMINAL

[75] Inventors: Raymond H. Van Wagener, Darien, Conn.; Fred P. Bauer, Mendenhall, Miss.; Hans L. Wattenbach, Wayne, N.J.

[73] Assignee: Universal Manufacturing Corporation, Paterson, N.J.

[21] Appl. No.: 936,809

[22] Filed: Dec. 2, 1986

[51] Int. Cl.[4] ..... H01R 11/12

[52] U.S. Cl. ..... 439/883

[58] Field of Search ..... 339/276 S, 277 R, 277 C; 439/877–883

[56] References Cited

U.S. PATENT DOCUMENTS

| | | | |
|---|---|---|---|
| 533,910 | 2/1895 | Metzger | 439/877 |
| 849,028 | 4/1907 | Stevens | 339/276 S X |
| 1,274,543 | 8/1918 | Heineman | 339/277 R |
| 4,488,770 | 12/1984 | Wi et al. | 339/277 R X |

FOREIGN PATENT DOCUMENTS

| | | | |
|---|---|---|---|
| 129872 | 1/1985 | European Pat. Off. | 339/277 R |
| 419005 | 9/1925 | Fed. Rep. of Germany | 339/276 S |
| 25053 | of 1899 | United Kingdom | 439/881 |
| 233841 | 5/1925 | United Kingdom | 439/883 |
| 234374 | 5/1925 | United Kingdom | 439/883 |
| 1162650 | 8/1969 | United Kingdom | 439/883 |

OTHER PUBLICATIONS

Western Electric Co, Tech Digest No. 61, Jan. 1981, p. 1.

*Primary Examiner*—Eugene F. Desmond
*Attorney, Agent, or Firm*—Darby & Darby

[57] ABSTRACT

An integral terminal made from a non-stranded, electrically conductive wire has a portion of the wire which is distorted and flattened from its normal shape in first and second dimensions relative to the axis of the wire into a substantially flat piece. This flat piece has substantially increased surface area and reduced thickness relative to the original cross-sectional area of the wire and which can be bent. The flat piece has an integral part formed therefrom extending in a third dimension different from the first and second dimensions for making mechanical engaging contact with an external post or pin where the third dimension is in a direction above or below the flat piece.

9 Claims, 3 Drawing Sheets

CONDUCTIVE WIRE WITH INTEGRAL ELECTRICAL TERMINAL

FIELD OF THE INVENTION

The present invention relates to electrical terminals and in particular to an arrangement for making a terminal integral with an electrically conductive wire.

Numerous applications exist where an electrical terminal must be used, for example, to make contact between some part, such as the end, of a wire and another stationary terminal or mounting pin or post to which one or more electrical wires are to be connected. In the present state of the art, a typical way to do this is to provide a separate terminal which is connected to the end of the wire. The separate terminal accommodates the post or other similar mounting member to which the wire is to be ultimately electrically connected.

Separate electrical terminals themselves are connected to the electrical wire, for example, by soldering, a mechanical crimping operation, etc. While these arrangements are, of course, effective from the electrical connection point of view, they are relatively costly when it is considered that first the separate terminal must be made and thereafter the terminal must be attached to the wire before the terminal is connected to the mounting member.

BRIEF SUMMARY OF THE PRESENT INVENTION

The present invention relates to a terminal arrangement which is integral with the wire which is to be connected to the mounting member. In accordance with the invention, an electrically conductive wire, for example, of copper or aluminum, is used. A mechanical pressure is applied to a conductive part of the wire to flatten it and thereby to increase its surface area from the normal generally cylindrical wire shape. This enlarged flattened area of the original wire can be used as a terminal for connecting the wire to another member.

The terminal so formed can be modified, for example, by forming a hole or other opening in it. The opening can then be fitted over an electrically conductive mounting post or pin. The enlarged wire area also can be used as a wraparound type terminal which is wrapped around one or more other wires, mounting posts, etc. The enlarged area can also be formed into other shapes and provided with other types of connecting arrangements to suit a variety of applications. The terminals are basically designed to make a mechanical connection and the electrical connection is completed by, for example, soldering or welding the terminal to the member to which it is attached.

OBJECT OF THE INVENTION

It is therefore an object of the present invention to provide an integral terminal for an electrically conductive wire.

A further object is to provide a terminal to be used to mechanically and electrically connect an electrically conductive wire to another member, such as a mounting pin or post, in which the wire has a part thereof formed in a particular terminal shape integral with the wire.

Another object is to provide an integral terminal for an electrically conductive wire in which the terminal is shaped by swaging, or otherwise increasing its surface area, and thereafter forming in the wire one or more openings to accommodate a particular shaped stationary terminal.

Other objects and advantages of the present invention will become more apparent upon reference to the following specification and annexed drawings in which:

DETAILED DESCRIPTION OF THE INVENTION

Figure 1A:
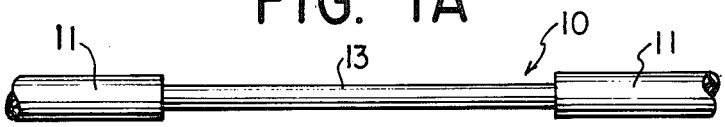
FIG. 1A is a view of a section of electrically conductive wire having a portion thereof stripped of insulation.

Referring to the drawings, FIG. 1A shows a typical electrically conductive wire 10, which is made of copper or aluminum typically, or any other combination of suitable electrically conductive material as is conventional. The wire 10 is shown having insulated portions 11 which can be of any suitable material such as cloth, plastic, composition materials, as is conventional, on its two ends and an intermediate section 13 which has been stripped of insulation to expose the generally cylindrical conductive wire portion.

Figure 1B:
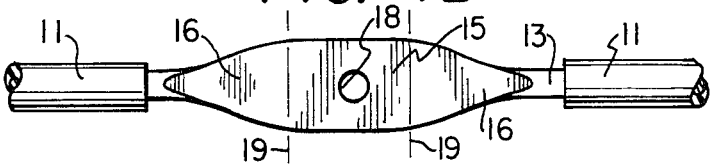
FIG. 1B is a plan view of the wire section of FIG. 1A after being worked on to form the terminal section.

FIG. 1B shows the terminal which is formed from the wire section 13 of FIG. 1A. Generally, the exposed wire section 13 is worked and subjected to a high degree of mechanical pressure which can be, in the simplest form, banging it with a hammer to flatten it out or, in a typical production situation, to have it subjected to high-pressure between two rollers, a stamping or pressing operation, etc. This is sometimes called swaging. After this working operation is carried out, the intermediate exposed electrically conductive section 13 has been flattened out into a terminal section 15 which is of considerably greater surface area than the normal cylindrical shape of the exposed wire section 13. The exact shape and size of the terminal section 15 depends upon a number of factors, e.g. the original diameter of the wire section 13, the malleability of the wire, the working force that was applied to it, the shape of the rollers or dies used to apply the force to form the terminal section, etc. In general, it can be said that substantially any terminal shape can be formed within limits depending upon the final required thickness of the terminal section 15, i.e. the thickness remaining of the terminal section must be great enough to support its final application.

The terminal section 15 is shown to be generally rectangular with tapered ends 16 making the transition between terminal section 15 and the cylindrical wire portion 13. The tapered transition sections prevent stress concentration between the terminal and the cylindrical wire portion. A hole 18 is formed in the center of the terminal section 15 by any suitable stamping, drilling or other similar operation. It should be considered that the terminal section 15 is relatively thin and relatively malleable so that the hole 18 can be made very easily.

Figure 1C:
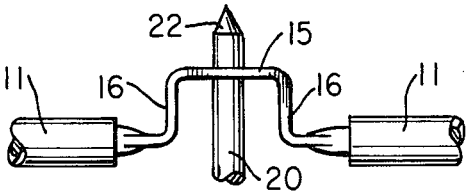
FIG. 1C is an elevational view showing the terminal of FIG. 1A attached to a mounting post.

FIG. 1C shows the terminal 15 mechanically attached to an electrically conductive mounting pin or post 20 of generally cylindrical configuration which has a peaked upper end 22. Such a mounting post would be found, for example, on a printed circuit board, a stationary terminal strip to which one or more other of wires are to be connected, etc. Such other wires usually are wrapped around the post or have a terminal thereon.

As seen in FIG. 1C, the terminal section 15 is bent by 90° in each transition area 16 along the dotted line 19 to form a stepped configuration so that the transition sections 16 raise the central terminal section 15 above the axis of the wire. This is done so that the wire insulation 11 can lie against the member to which the post 20 is attached and the terminal 15 can be more easily mounted and positioned on post 20. Also, if the post 20 in the connected wires and terminals are to be dipsoldered the raised terminal 15 prevents the insulated portions of the wire from contacting the solder. It is not necessary to perform this bending step to raise section 15, as will be shown in other embodiments of the invention.

As seen in FIG. 1C, the wire 10 is now mechanically fastened via integral terminal section 15 to the mounting post 20. Additional terminals can be connected to the mounting post 20, these being either of the integral type as previously described or of the more conventional type which themselves were separate members and attached to the wire. The terminals are usually permanently electrically connected to the post such as by welding, soldering, etc. It is preferred that there be some space between the post 20 and the terminal 15 around the hole 18 so that the solder or weld material can flow into the space by capillary action to make a strong electrical and mechanical bond.

Figure 2A:
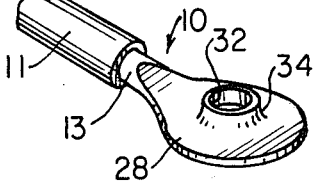
FIG. 2A is a perspective view of another type of terminal made integral with the wire.
Figure 2B:
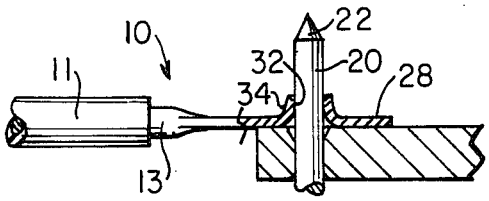
FIG. 2B is a side elevational view showing the integral terminal of FIG. 2A attached to a mounting post.

FIGS. 2A and 2B show a further embodiment of the invention. Here, the integral terminal is at the end of the insulated portion 11 of the conductive part 13 of the wire 10. In this embodiment, the mechanical working of the wire uses dies to form a generally circular terminal section 28 having the tapered transition section 16 back to the wire 13. In addition, a hole 32 is formed in the center of the generally circular terminal 28, the hole having a raised sloping shoulder 34 around its periphery.

FIG. 2B shows terminal 28 placed on the mounting post 20, the post here shown as being part of a transformer or coil bobbin or printed circuit board 35. As can be seen, the terminal hole 32 is placed over the post. The raised shoulder 34 provides a greater surface area for capillary attraction of solder so that there can be good mechanical and electrical contact between the terminal 28 and the post. As before, one or more other terminals, wires, etc. can also be connected to the post and thereafter a final electrical connection is made such as by soldering, welding, etc.

Figure 3A:
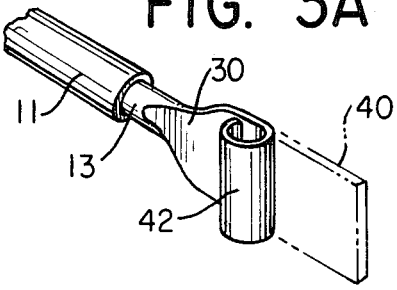
FIG. 3A shows an elevational view of another form of terminal which is to be wrapped around a member and FIG. 3B is an elevational view showing how it is wrapped around a mounting post.
Figure 3B:
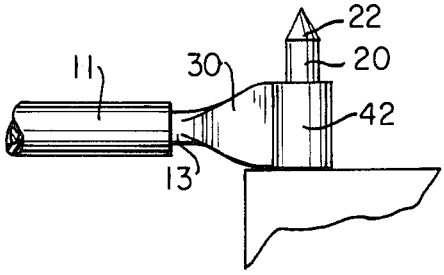

In the embodiment of FIGS. 3A and 3B, the uninsulated end of the wire 13 is made somewhat longer than in the previous embodiments and a generally rectangular terminal 40 is formed. Thereafter the original generally rectangular terminal section 40, which is shown in the dotted lines, is rolled to form a generally cylindrical terminal 42. As shown in FIG. 3B, the rolled cylindrical terminal 42 is placed over the mounting post 20. The diameter of the terminal roll can be equal to or slightly smaller than that of the past. Since the end of the terminal roll is free, the roll can expand to produce a good force-fit type connection. Thereafter, the final electrical connection can be made by soldering or welding.

Figure 4A:
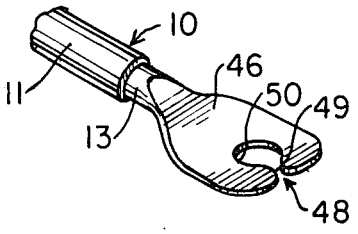
FIG. 4A shows a form of a snap-on terminal in perspective view and FIGS. 4B and 4C are top and side views showing the manner in which it is attached to a mounting post.
Figure 4B:
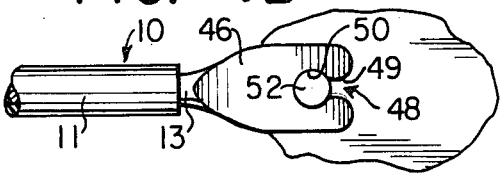
Figure 4C:
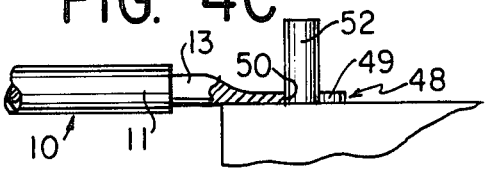

FIGS. 4A and 4B show another embodiment of the invention in which the conductive end 13 of the wire 10 has been formed with an integral terminal 46 having a post mounting opening 48 with a narrow front entry part 49 and a larger post accepting part 50. As seen in FIG. 4B, terminal 46 is usually snapped over a mounting post 52 which does not necessarily have a peaked upper end, although it could have. The presence of the narrow entry opening 49, which forms two entry arms, permits a slight spreading action as the post is moved into the main opening 50. Thus, terminal 46 can be placed over the post 52 right into the central opening 50 or by inserting the post through the entry opening 49.

Figure 5A:
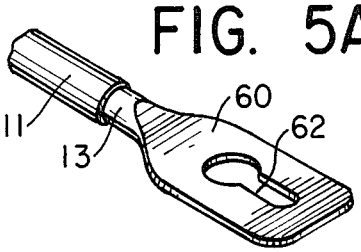
FIGS. 5A and 5B show perspective and top views of a wedge type of terminal with a keyhole type of attaching arrangement.
Figure 5B:
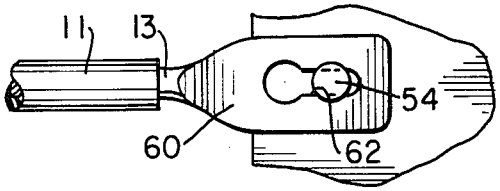

FIGS. 5A and 5B show a further embodiment of the invention wherein an uninsulated end of the wire 13 is swaged or otherwise similarly operated upon to form a terminal 60 into which a keyhole opening 62 is thereafter cut or stamped. FIG. 5B shows the terminal connected to a post 54. In operation, the terminal 60 would be placed over the post 54 through the widest part of the keyhole opening 62 and the terminal thereafter pulled back with the narrowest part of the keyhole opening wedging on the post since the terminal material is malleable and will distort slightly. Thereafter, as before, a further electrical connection can be made with another terminal and the final electrical connection be made such as by soldering, crimping, etc.

Figure 6A:
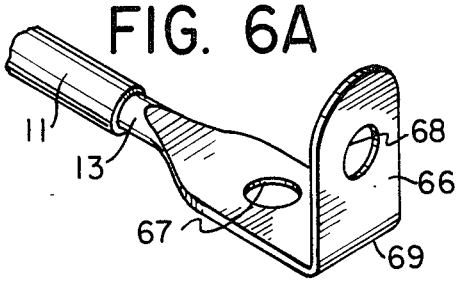
FIG. 6A is a perspective view of still a further embodiment of a wedge type terminal and FIG. 6B shows the terminal attached to the mounting post.
Figure 6B:
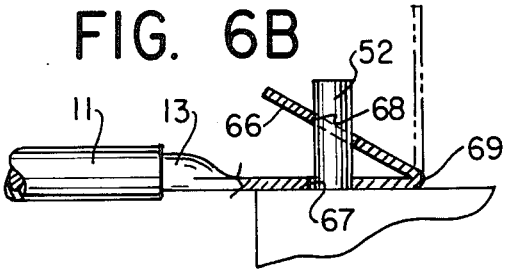

In the embodiment of FIGS. 6A and 6B the terminal 66 is formed initially as an elongated generally rectangular piece and two spaced holes 67 and 68 are made. The terminal 66 is then bent at 69 in the area between the two holes into a generally V-shape with one of the holes in each arm of the V. The terminal 66 is placed over the mounting post 52 by squeezing the two arms of the V together and by inserting the post through holes 67 and 68. The two arms are then released and wedged against the post as shown in FIG. 6B. Again, there can be a further soldering or welding of the terminal to the post.

Figure 7A:
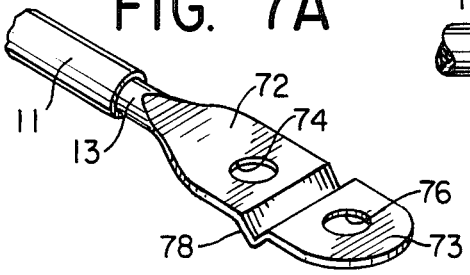
FIG. 7 is a perspective view of another embodiment of terminal adapted to be connected to two mounting posts and to accommodate for variations in center to center distances between the mounting posts.
FIG. 7B shows the terminal mounted to the posts.
Figure 7B:
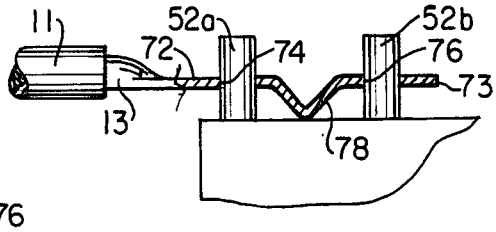

In FIGS. 7A and 7B a terminal 72 is formed with a generally elongated rectangular shape with a rounded end 73, although this is not necessary. The terminal 72 is adapted to be connected to two mounting posts. Two holes 74 and 76 are formed in the terminal spaced apart by a distance corresponding to the two mounting posts to which the terminal is to be attached. The piece 72 is also bent to have an indented V-shaped hinge section 78 in the space between the two holes 74, 76.

As seen in FIG. 7B, the terminal 72 is placed over two mounting posts 52*a* and 52*b* which were spaced apart a distance corresponding to the spacing between the two holes 74 and 76. The peak of the V-shaped section 78 acts as a hinge line so that the piece 72 can be bent around this line to change the spacing between the two holes 74 and 76. This accomodates for variations in spacing between the holes and/or the two mounting posts. The peak of the V which extends from the plane of the terminal also can rest on top of the printed circuit board, or other support member 34, to which the posts 52 are mounted to provide support for the terminal 72 against member 34.

Figure 8A:
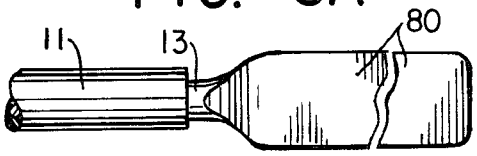
FIG. 8A is plan view of an integral terminal which is to be wrapped around a mounting post.
Figure 8B:
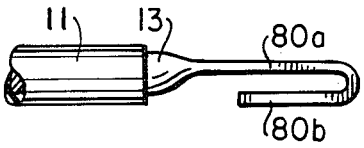
FIG. 8B shows the terminal in side view and FIG. 8C shows the terminal mounted on the post.
Figure 8C:
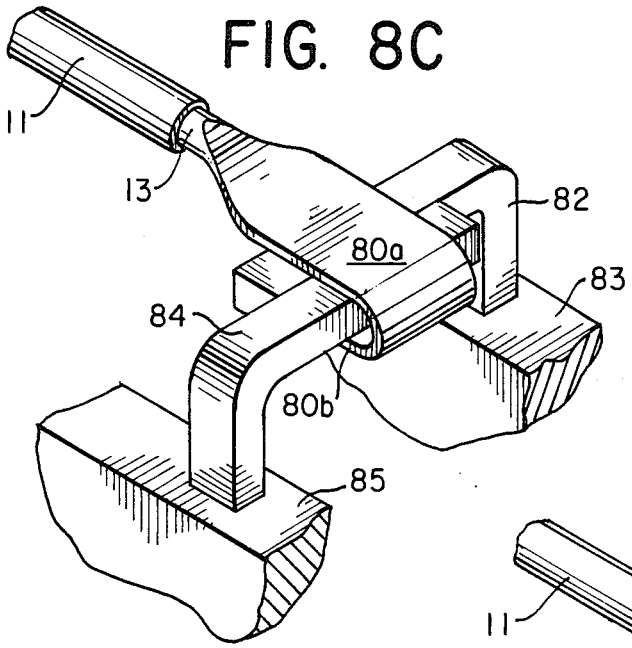

FIGS. 8A, 8B, and 8C show a terminal 80 formed at the end of the wire 13 of generally elongated rectangular shape with rounded corners. As seen in FIG. 8B, the rectangular section is bent to have an upper portion 80*a* and a lower portion 80*b*.

FIG. 8C shows the use of the terminal 80 in providing an electrical connection between two adjacent generally L-shaped mounting lugs 82 and 84, which are shown mounted on an underlying supporting member 83 or 85, this being a printed circuit board, a bobbin, pair of terminal strips, etc. As seen, the open portion between the two terminal sections 80*a* and 80*b* accommodates the two terminal lugs 82 and 84 merely by placing them thereover. As before, if desired, the terminal can be further permanently electrically connected to the lugs such as by soldering or welding.

Figure 9A:
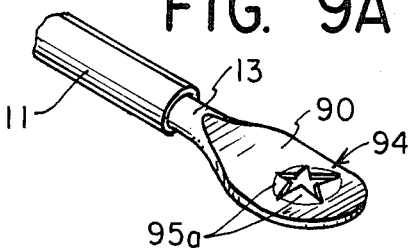
FIGS. 9A, 9B and 9C show a further form of terminal having gripping surfaces with FIG. 9A being in perspective, FIG. 9B a side elevational view and FIG. 9C showing the terminal attached over the post.
Figure 9B:
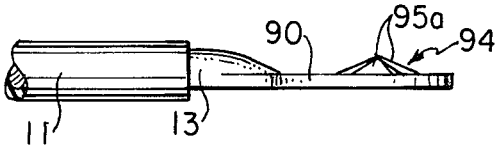
Figure 9C:
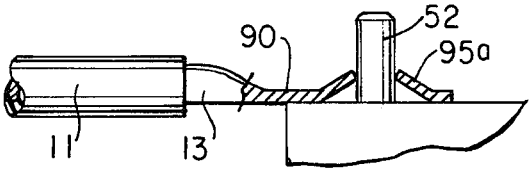

FIGS. 9A, 9B, and 9C a terminal 90 is formed on an end of the wire 13 of a generally rectangular or part circular shape. A star-shaped openinq 94 is cut into the terminal 90 leaving raised arms 95*a* which have rather sharp bottom edges. As seen in FIG. 9C, when the opening 94 is snapped over the terminal lug 52, which is generally of somewhat larger diameter than the openings at the edges of the star-shaped opening 94, the arms 95*a* grip the terminal lug 52 with their bottom edges biting into the lug to make a firm electrical connection. The spaces between the arms 95*a* provide for capillary attraction of solder. The flat section of terminal 90 adjacent the transition 16 to the cylindrical wire 13 provides a mounting support to the member 34.

The present invention provides a relatively economical way for forming an electrical terminal which is integral with the electrical wire. This avoids the necessity of first forming a separate electrical terminal and thereafter connecting it to the wire. In addition, the fact that the terminal is integrally formed with the wire permits the production of a number of unique terminal configurations which would be either difficult to produce where separate terminals are used or else would be difficult to connect to the wire in view of the different shapes of the terminals.

What is claimed is:

1. An integral terminal comprising:

a non-stranded, electrically conductive wire, a portion of said wire being distorted and flattened from its normal shape in first and second dimensions relative to the axis of the wire into a substantially flat piece having subsantially increased surface area and reduced thickness relative to the original cross-sectional area dimension of the wire and which can be bent, and said flat piece having an integral part formed therefrom extending in a third dimension different from said first and second dimensions for making mechanical engaging contact with an external means, said third dimension being in a direction above or below said flat piece.

2. An integral terminal as in claim 1 wherein said integral part of said piece comprises a first section with an opening therein, and a section on each side of said first section bent a way from said piece at substantially a right angle to said first section so that said first section is a platform displaced from the original flat piece and the axis of the wire, and, said first section having a hole therethrough.

3. An integral terminal as in claim 2 wherein the wire has insulation thereon on the undistorted portion adjacent each of said bent sections.

4. An integral terminal as in claim 1 wherein said piece has a hole therethrough and the integral part of said piece comprises an upwardly sloping shoulder surrounding said hole.

5. An integral terminal as in claim 4 wherein said upwardly sloping shoulder has a plurality of arms extending from the periphery toward the center of the hole.

6. An integral terminal as in claim 1 wherein said integral part of said piece comprises a pair of walls bent from said piece in a generally V shape, and a hole in the piece on each side of the apex of the V.

7. An integral terminal as in claim 1 wherein said integral part is formed by a portion of said piece being bent back toward said wire, and a hole in the bent portion and the piece aligned for fitting over a common lug.

8. An integral terminal as in claim 1 wherein said integral part is formed by a bend in said piece of a generally U-shape forming an opening to fit around at least one mounting lug.

9. An integral terminal as in claim 1 wherein said integral part is formed by a roll of a portion of said piece in a generally cylindrical shape.

* * * * *